United States Patent [19]

Beckstead et al.

[11] Patent Number: 4,920,762

[45] Date of Patent: May 1, 1990

[54] CRYOGENIC TARGET AND METHOD AND APPARATUS FOR MAKING SAME

[76] Inventors: Gary K. Beckstead, 3532 Baringwood Cir., Kearns, Utah 84118; Dennis L. Fleming, 4280 Mackay Dr., Salt Lake City, Utah 84119

[21] Appl. No.: 179,837

[22] Filed: Apr. 11, 1988

[51] Int. Cl.[5] ..... F25C 1/06

[52] U.S. Cl. ..... 62/353; 62/356; 249/161; 425/412; 425/436 R; 425/556

[58] Field of Search ..... 62/340, 353, 356; 249/79, 144, 161; 425/552, 577, 256, 258, 259, 261, 406, 412, 416, 422, 436 R, 441, 447, 457, 547, 548, 554, 556, 574, 575

[56] References Cited

U.S. PATENT DOCUMENTS

| | | | |
|---|---|---|---|
| 2,763,996 | 9/1956 | Lees | 62/353 X |
| 3,363,039 | 1/1963 | Nagari et al. | 425/441 X |
| 3,679,339 | 7/1972 | Tucker | 425/444 X |
| 4,099,946 | 7/1978 | Alexander | 62/73 |
| 4,147,324 | 4/1979 | Walter | 249/121 X |
| 4,635,817 | 1/1987 | Kostov | 249/121 X |
| 4,781,571 | 11/1988 | Heindl et al. | 425/556 |

*Primary Examiner*—William E. Tapolcai

[57] ABSTRACT

Method and apparatus for producing cryogenic targets, and the target itself and including a mold assembly, a cryogenic system, a control system and the target produced in the mold and adapted to be propelled by a target thrower assembly.

3 Claims, 2 Drawing Sheets

CRYOGENIC TARGET AND METHOD AND APPARATUS FOR MAKING SAME

BRIEF DESCRIPTION

1. Field of the Invention

This invention relates to target shooting and particularly to the shooting objects propelled into the air in simulation of bird flight.

2. Prior Art

The use of objects propelled through the air in simulation of bird flight and as target to improve the marksmanship of a shooter have long been known.

In the past a variety of materials have been proposed for use of targets for shooters. U.S. Pat. No. 1,378,340, for example, discloses a target of bullet proof material, such as steel, having central disks of frangible material that will shatter when hit by a bullet. Another target, made of wood or other suitable frangible material is disclosed in U.S. Pat. No. 1,821,330.

Bulls-eye targets having frangible centers are disclosed in U.S. Pat. No's. 1,825,292 and 1,970,676 and a frangible target, of wood, is shown in U.S. Pat. No. 2,076,135.

For many years it has been popular to make clay "pigeons" out of clay materials having a disk configuration.

While these known targets are all relatively inexpensive it remains desirable to even further reduce the costs for targets that are to be used only once and where large numbers of targets are used.

To reduce the costs of the targets it is necessary to reduce the costs of the materials from which they are made and/or the labor involved in producing and handling them. This includes the reduction of shipping and storage costs.

OBJECTS OF THE INVENTION

It is a principal object of the present invention to provide a frangible shooting target suitable for use as an air propelled target that is made out of very low cost materials.

It is another object of the present invention to provide a frangible shooting target that is constructed with a minimum of labor and handling.

It is still another object to provide apparatus and method for producing frangible shooting targets, on site, essentially as rapidly as they are desired for use during shooting practice.

FEATURES OF THE INVENTION

Principal features of the invention include a shooting target in the form of a saucer-shaped disk and made of ice.

Still other features of the invention include a method of making shooting targets of ice and mold apparatus for automatically forming freezing and discharging the cryogenic targets at a rate consistent with needs of one or more shooters during target practice.

Additional objects and features of the invention will become apparent from the following detailed description and drawing.

THE DRAWINGS

In the drawings:

FIG. 1 is a perspective view of the apparatus for forming cryogenic targets of the invention;

FIG. 2, a side elevation view;

FIG. 3, an enlarged vertical section, taken on the line 3—3 of FIG. 2; and

FIG. 4, a perspective view of a target of the invention.

DETAILED DESCRIPTION

Figure 1:
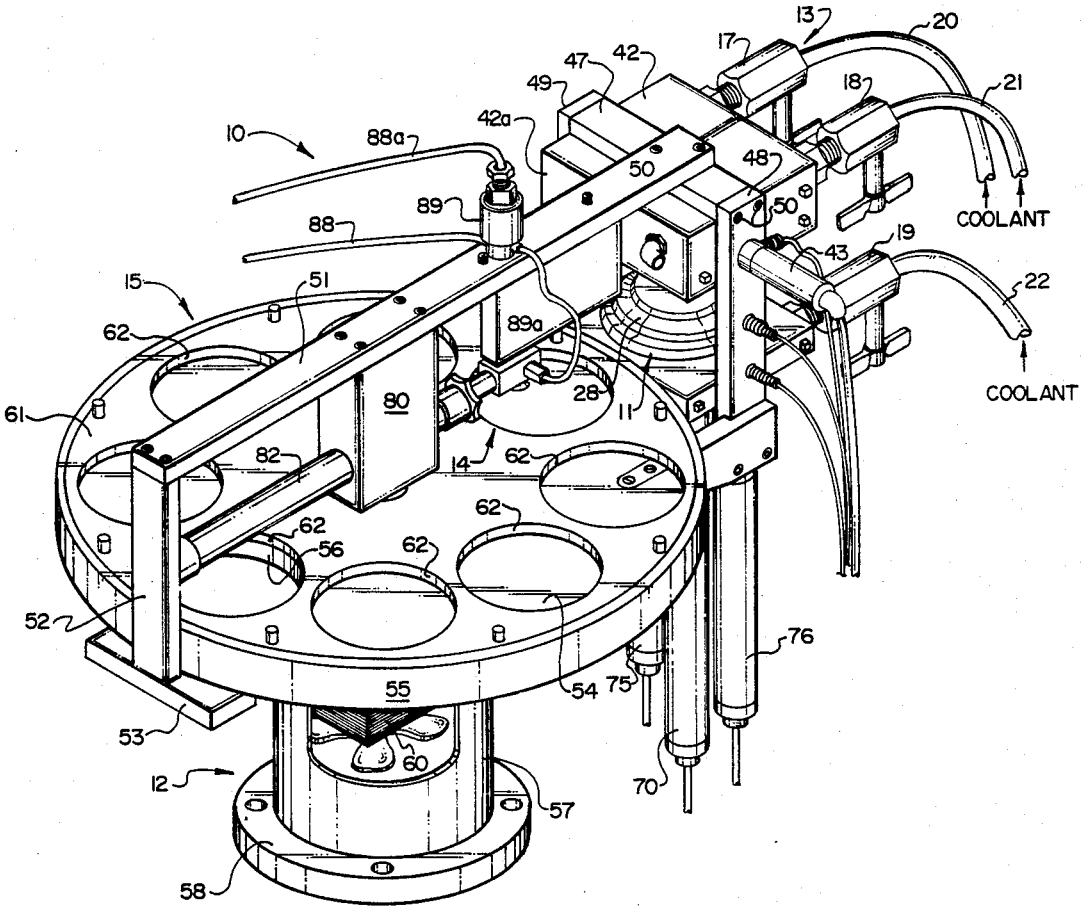
Figure 2:
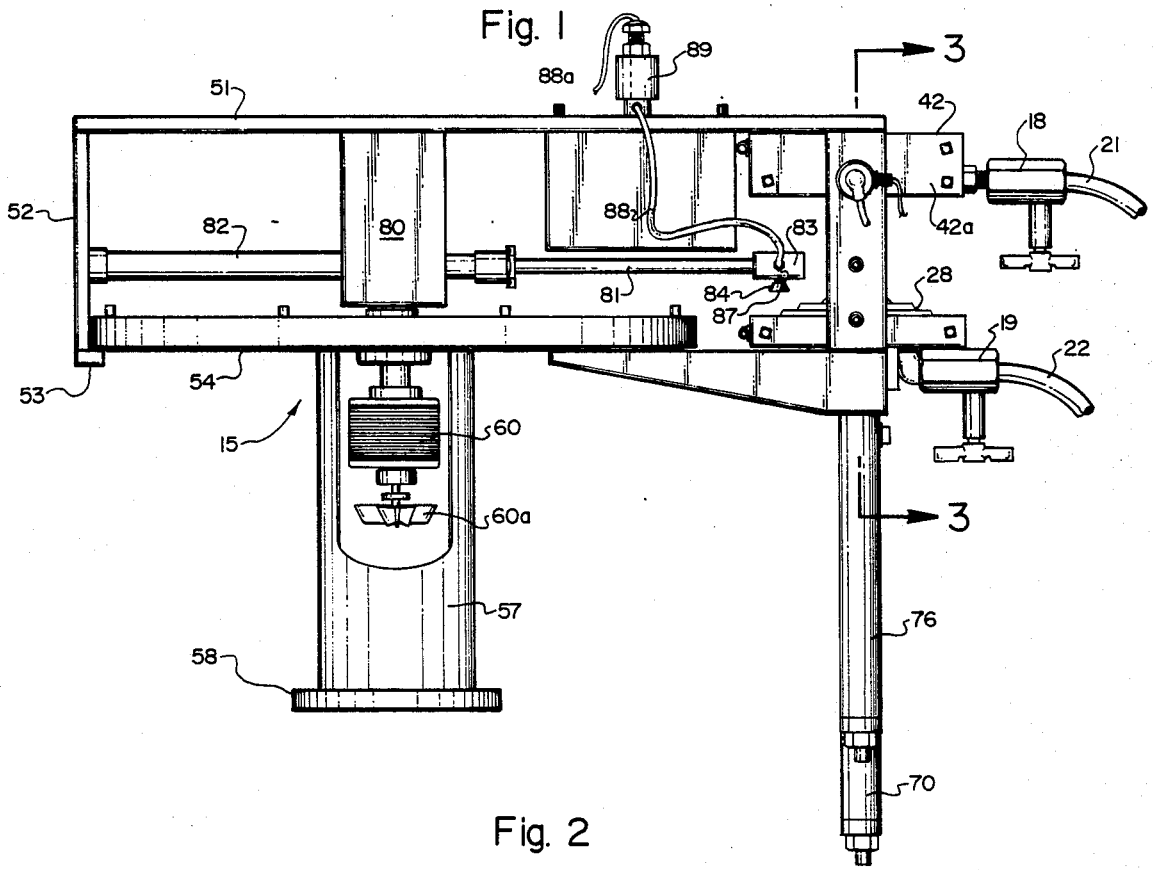
Figure 3:
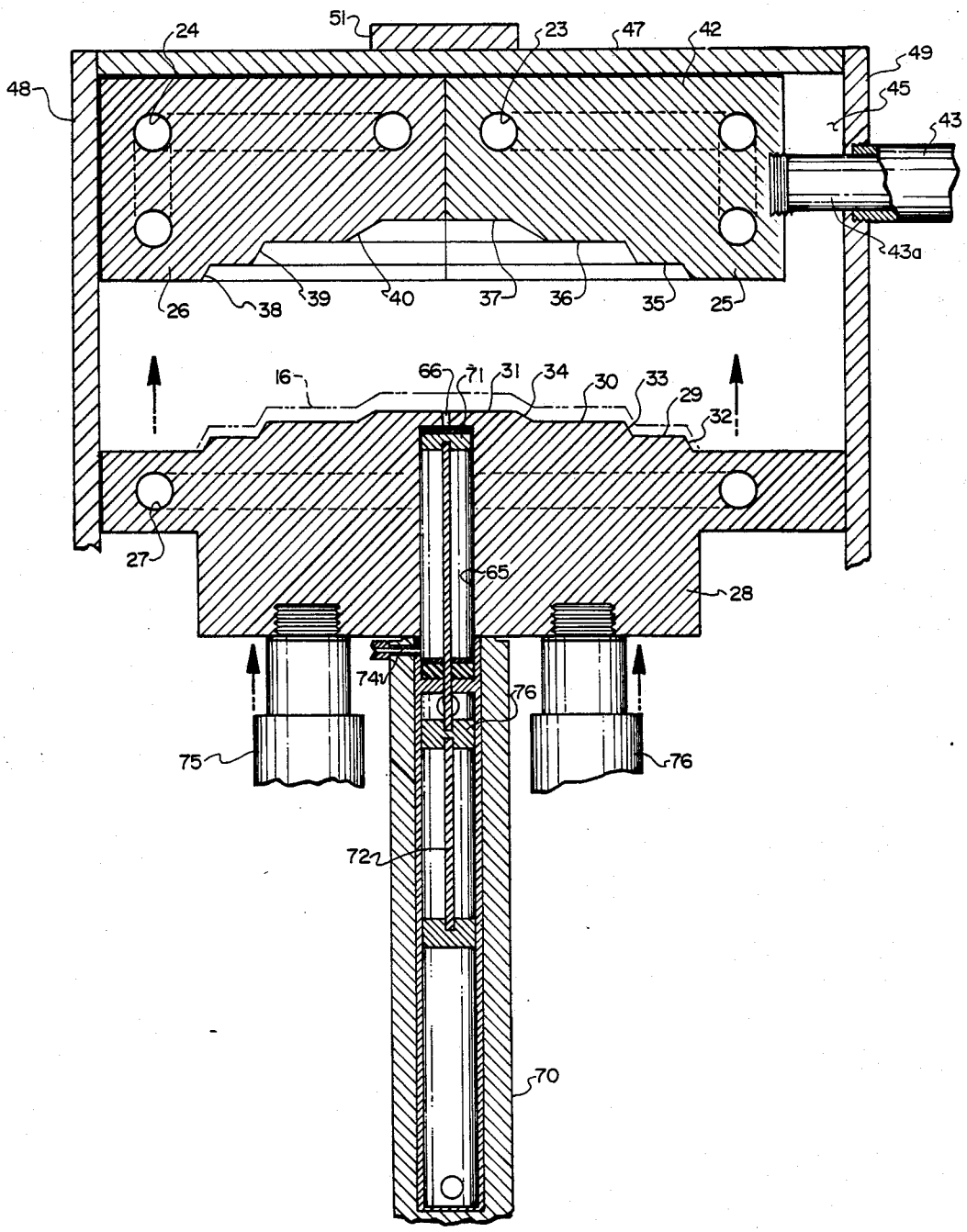

Referring now to the drawings:

In the illustrated preferred embodiment the apparatus for making cryogenic targets of the invention is shown generally at 10.

In the embodiment shown, the apparatus 10 includes a mold unit 11, a mold assembly base 12, a cryogenic system 13, an arm assembly 14 and a carousel 15.

Figure 4:
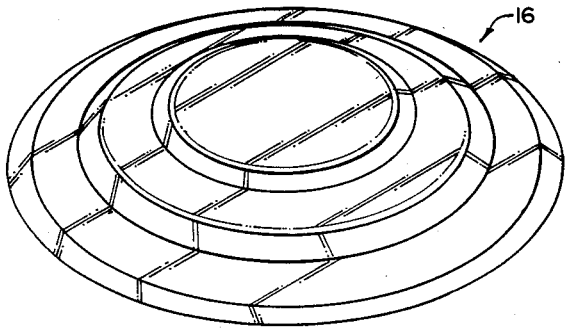

As will become apparent, a refrigerant, such as Freon, is injected through the cryogenic system 13 into the mold unit 11 so that it will freeze water also injected into the mold assembly 14 into a desired saucer shaped disk 16, FIG. 4. The disk 16 is automatically removed from the mold unit 11, and is placed on the carousel 15.

The refrigerant is supplied, under pressure, through the cryogenic system, which includes valve 17, 18 and 19 in insulated supply lines 20, 21 and 22, respectively. The supply lines 17 and 18 respectively open into bores 23 and 24 in upper mold halves 25 and 26 and bore 27 in a lower mold 28.

The mold 28 has a mold surface formed with raised steps 29, 30 and 31 thereon and with inclined shoulders 32, 33 and 34 respectively interconnecting the mold face to step 29; step 29 to step 30; and step 30 to step 31.

The mold halves 25 and 26, when held together form a female mold surface with recessed steps 35, 36 and 37, respectively interconnected by inclined shoulders 38, 39 and 40. The female mold surface conforms generally to the shape of the male mold surface, but is larger, such that when the mold 28 is moved tightly against the mold halves 25 and 26 a space exists between the male and female mold surfaces.

The mold halves 25 and 26 are positioned in an upper portion of a housing 42, with the mold half 26 fixed against movement therein. Mold half 25 has a piston rod **43*a* of a pneumatic cylinder 43 threaded therein and the mold 25 is pressed against cylinder half 26, by the cylinder 43. A small space 44 exists between a side wall 45 of the cylinder half 25 and the side wall 42*a* of housing 42. When the cylinder 43 is actuated rod 43*a* is ejected and mold half 25 is held tightly against mold half 26. Upon release of pressure in cylinder 43 the rod 43*a* is retracted and the mold half 25 is moved away from mold half 26, within the space 44** to thereby release the target from the mold halves.

Lower mold 28 forms a bottom wall of the housing 42 and reciprocates upwardly into engagement with mold halves 25 and 26 and downwardly, out of engagement with the mold halves and out of the housing to permit target removal.

Housing 42 is supported by a framework comprising a top rail 47 and a pair of side rails 48 and 49. Bolts 50 secure the housing to the top and side rails.

A main support arm 51 extends over the carousel 15 and has one end bolted by bolts 50 to the top rail 47 and the opposite end thereof bolted to a support post 52 by other bolts 50. The support post 52 rests on and is supported by a shelf 53 that is fixed to and projects from the base plate 54 of the carousel 15. The base plate 54 is of flat circular configuration, with an upstanding surrounding rim 55, and with a discharge opening 56 therethrough. The base plate 54 is supported on a tubular support stand 57 with a bottom flange 58. The bottom flange is adapted to be bolted or otherwise affixed to a target thrower, not shown.

A stepping motor 60 having a cooling fan 60*a* is positioned in the stand 57 and is fixed to and suspended from the base plate 54. The output shaft of motor 60 extends through base plate 54 to drive a turntable 61. The turntable 61 has a plurality of holes 62 spaced around the periphery thereof, and, as will be further explained, the holes 62 are turned to place them sequentially in registry with discharge opening 56 and sequentially in position to receive a molded and frozen target 16.

Water to be frozen into the shape of a target, i.e. saucer shaped, is injected into the space between the male and female molds after lower mold 28 has been moved into engagement with mold halves 25 and 26. For this purpose a piston bore 65 is provided centrally into lower mold 28. A port 66 then connects the bore 65 to the space formed between the male and female molds when the lower mold 28 and mold halves 25 and 26 are in engagement.

A pneumatic cylinder 70 is mounted to the bottom of lower mold 28 and moves with the lower mold. A piston 71 on the end of the cylinder rod 72 reciprocates into the bore 65 to close the port 66 to isolate water being frozen from water supplied from outside the mold, and reciprocates into a bore 73 aligned with the bore 65 to permit flow of the supply water through an inlet 74 to the bores 73 and 65. As will be further explained, after water flows into bores 73 and 65 the flow is stopped and the pneumatic cylinder 70 is actuated to expel piston 71 and to force the water through port 66 into the space between the male and female molds. Since the molds are cooled, as previously described, by the refrigerant, the water injected between the molds is formed to conform to the shapes of the male and female molds.

A pair of fluid cylinders 75 and 76 have their cylinder rods 75*a* and 76*a* threaded into the bottom of the lower mold 28 to reciprocate the mold into engagement with the mold halves 25 and 26 so that the target can be formed and frozen, out of housing 42, and then slightly upward as required for target release, and as will be further described.

A pneumatically powered drive 80 is bolted by bolts 50 to the rail 51 and drives a long rod 81 that telescopes into a tubular housing 82. A head 83 is carried by the rod 81 and a suction cup 84 is affixed to the head. The suction cup has a bore 87 extending therethrough to the suction face thereof and a source of air pressure (not shown), a source of vacuum (not shown) are respectively connected by conduits 88 and 88*a* through a valve 89, conduit 89*a* and head 83 to the bore 87.

In operation, the mold halves 25 and 26 and lower mold 28 are cooled by the introduction of refrigerant. The cylinder 75 and 76 are operated to place the lower mold 28 tightly against the mold halves 25 and 26 and an injection of water is made by piston 71 into the space between the male and female molds. Use of the piston 71 to inject predetermined quantities of water into the mold unit prevents freezing that could occur if only a pressure feed of water was used.

The molds are left closed until the injected water freezes into a saucer shaped target conforming to the male and female molds. It has been found that such a saucer-shaped with a stepped configuration and sloped shoulders can be made of a size and weight that will, when "thrown" have the same in-air breakage characteristics as the clay pigeons commonly used and will conform to established and/or expected flight standards of targets used in trap and skeet shooting.

After shaping and freezing, the half mold 25 is pulled back by cylinder 43 and the lower mold 28 is lowered by cylinders 75 and 76 until it is out of housing 42.

Thereafter, the rod 81 is expelled to position the vacuum suction cup 84 centrally over the target 16. The cylinders 75 and 76 are then again operated to raise the lower mold until the target engages the suction cup 84. The lower mold is then lowered again by the cylinders 75 and 76 and the target is held by vacuum pressure applied through the suction cup.

Rod 81 is withdrawn by operation of drive means 80 and the target is placed over a hole 62. The vacuum is broken and air is admitted to the suction cup and the target drops, a very short distance, into the hole 62 where it is supported by the base plate 54 of the carousel. The stepping motor is actuated to rotate the holes 62 with the targets therein sliding on base plate 54 and when the target 16 in each hole is above discharge opening 56 the target drops through the opening for use in a target thrower or the like. Each time the turntable 61*a* new hole 62 is provided to receive a target 16. Also, in full operation, each time the turtable is indexed a target 16 will fall through the discharge opening. It has been found that the targets can readily be produced and frozen solid at a rate of at least nearly one per minute.

The target of the invention is produced automatically from water without the need for manual assistance. It is shaped to have an established aerodynamic configuration, with a size, shape and weight similar to clay pigeons heretofore available. Consequently, the target is economical to produce and has the same flight characteristics as the more conventional clay pigeons. Also it is readily adapted for use with conventional throwing devices.

A conventional microprocessor control unit (not shown) may be used to operate the valves, fluid cylinders and electric drive motor to provide for the sequential operation of the apparatus of the invention and for cyclic operation so that targets will be produced, stored on the carousel and delivered for use.

Although a preferred form of our invention has been herein disclosed, it is to be understood that the present disclosure is by way of example and that variations are possible without departing from the subject matter coming within the scope of the following claims, which subject matter we regard as our invention.

We claim:

1. Apparatus for forming a target for use by shooters and the like, comprising a mold having a cavity formed within a lower mold portion and a pair of upper mold halves, said cavity being shaped to form a saucer shaped target;

means for injecting a volume of water into the mold cavity;

means for freezing the volume of water in the cavity into a target having a saucer shape; and means for removing the target from the cavity, said removing means including a fluid cylinder connected to one of said mold halves and operable to move said mold half relative to the other said mold half to separate the mold halves from one another and at least one fluid cylinder connected to said lower mold portion and operable to move said lower mold portion towards and away from said mold halves.

2. Apparatus as in claim 1, wherein the means for removing the target further comprises a rod;

means for extending and retracting said rod; and a suction cup carried by one end of the rod, whereby when said rod is extended said target is moved into engagement with said suction cup by the fluid cylinder connected to the lower mold portion.

3. Apparatus as in claim 2, further including a turntable having at least one hole therein to receive the target when the rod is retracted;

a base plate beneath the turntable providing a slide surface for said target and having a discharge opening therethrough;

means for rotating said turntable to position a hole beneath the target carried by the suction cup and to a position wherein the hole is over the discharge opening; and means for introducing air to the suction cup to release the target to the hole in the turntable.

* * * * *